US009039237B2

(12) United States Patent
Wang He

(10) Patent No.: US 9,039,237 B2
(45) Date of Patent: May 26, 2015

(54) ILLUMINATION DEVICE WITH HOLLOW POST AND REFLECTIVE CUP WITH TWO SERIALLY DISPOSED LENS DISPOSED THEREIN

(71) Applicant: HON HAI PRECISION INDUSTRY CO., LTD., New Taipei (TW)

(72) Inventor: Li-Ying Wang He, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 106 days.

(21) Appl. No.: 13/899,598

(22) Filed: May 22, 2013

(65) Prior Publication Data

US 2014/0211482 A1 Jul. 31, 2014

(30) Foreign Application Priority Data

Jan. 28, 2013 (TW) ..... 102103052 A

(51) Int. Cl.

| | |
|---|---|
| ***F21V 13/04*** | (2006.01) |
| ***F21V 5/00*** | (2006.01) |
| ***F21V 5/04*** | (2006.01) |
| *F21Y 101/02* | (2006.01) |

(52) U.S. Cl.

CPC ..... *F21V 13/04* (2013.01); *F21V 5/008* (2013.01); *F21V 5/045* (2013.01); *F21Y 2101/02* (2013.01)

(58) Field of Classification Search

CPC ..... F21V 5/008; F21V 5/045; F21V 5/04; F21V 13/04; F21Y 2101/02

USPC ..... 362/268, 331

See application file for complete search history.

(56) References Cited

U.S. PATENT DOCUMENTS

| | | | | |
|---|---|---|---|---|
| 6,290,368 | B1 * | 9/2001 | Lehrer | 362/187 |
| 2006/0002114 | A1 * | 1/2006 | Sun | 362/257 |
| 2009/0052182 | A1 * | 2/2009 | Matsuba et al. | 362/268 |
| 2012/0081901 | A1 * | 4/2012 | Tsang | 362/277 |

* cited by examiner

*Primary Examiner* — Robert May

(74) *Attorney, Agent, or Firm* — Novak Druce Connolly Bove + Quigg LLP

(57) ABSTRACT

An illumination device, includes a printed circuit board, a plurality of LED light sources mounted on the printed circuit board, a hollow supporting post covering the plurality of LED light sources, a reflective cup located above the supporting post, a first lens received in a bottom portion of the reflective cup and a second lens located at a top portion of the reflective cup. The supporting post is connected to the printed circuit board, and the first lens is connected to the supporting post. The reflective cup includes a bottom portion adjacent to the LED light sources and a top portion remote from the LED light sources. The printed circuit board, the reflective cup, the first lens and the second lens are combined as a whole by the supporting post.

17 Claims, 3 Drawing Sheets

ILLUMINATION DEVICE WITH HOLLOW POST AND REFLECTIVE CUP WITH TWO SERIALLY DISPOSED LENS DISPOSED THEREIN

BACKGROUND

1. Technical Field

The present disclosure relates to illumination devices, and particularly to an illumination device having a uniform distribution of light output.

2. Description of Related Art

LEDs have been widely promoted as light sources of electronic devices owing to many advantages, such as high luminosity, low operational voltage and low power consumption. However, to a big size backlight module, a lot of LED chips are needed to have a uniform distribution of light output, whereby the cost is increased, and the power is wasted.

Therefore, an illumination device which is capable of overcoming the above described shortcomings is desired.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
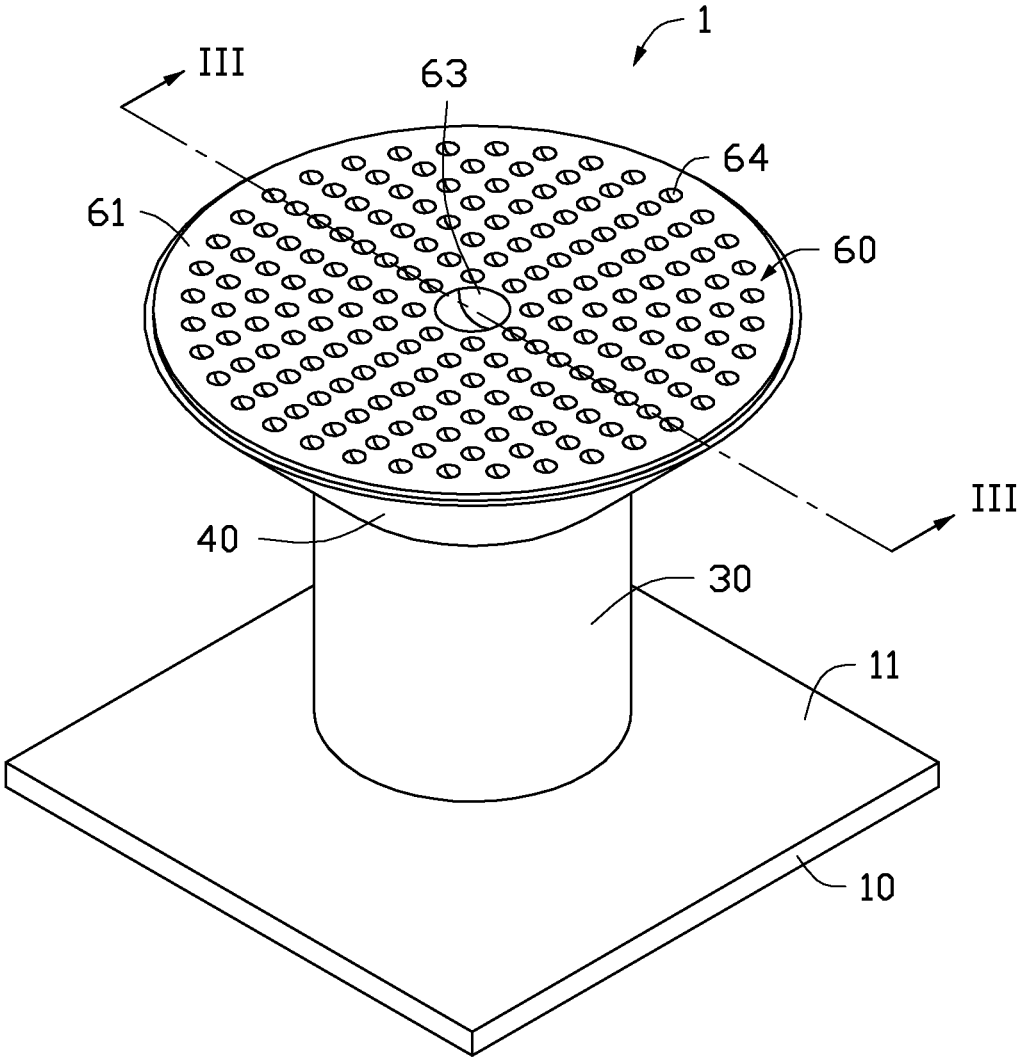
FIG. 1 is an assembled, isometric view of an illumination device in accordance with an exemplary embodiment of the present disclosure.
Figure 2:
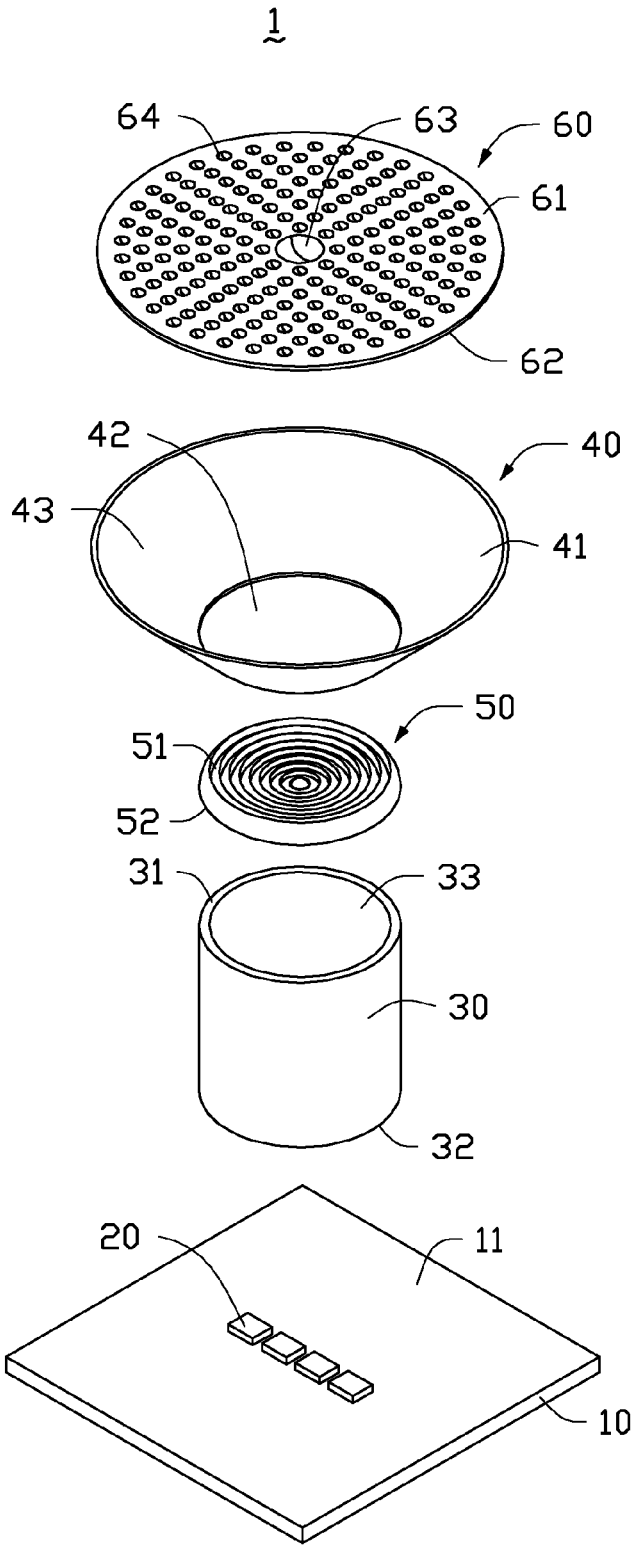
FIG. 2 is an exploded view of the illumination device of FIG. 1.
Figure 3:
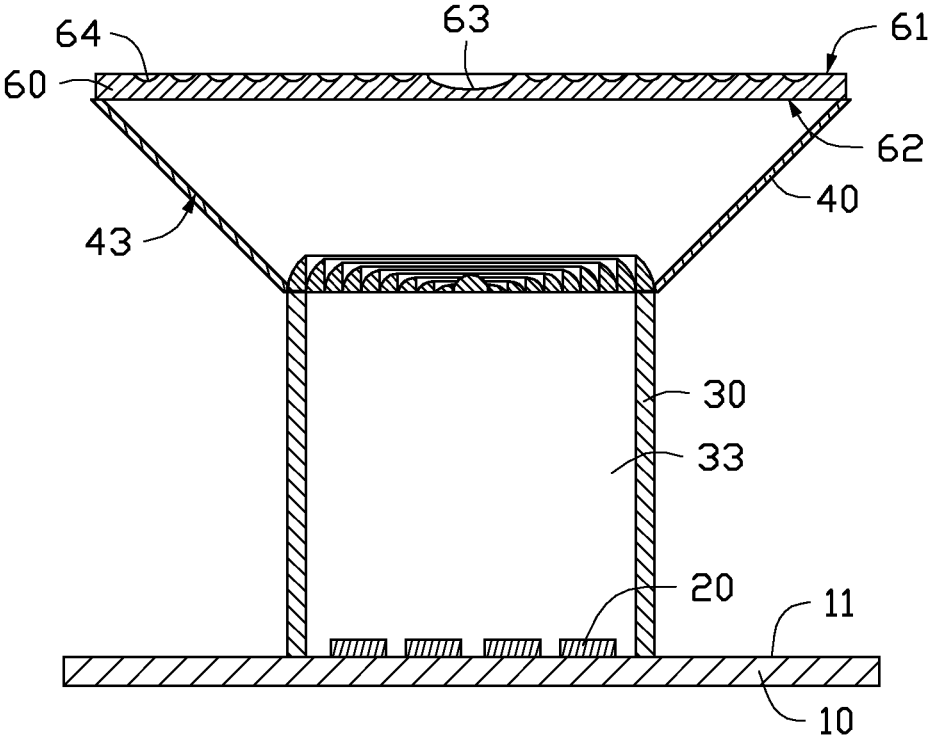
FIG. 3 is a cross section view of the illumination device of FIG. 1, taken along a line III-III thereof.

Referring to FIGS. 1 and 2, an illumination device 1 in accordance with an embodiment of the present disclosure includes a printed circuit board 10, a plurality of LED (light emitting diode) light sources 20 located on the printed circuit board 10, a hollow supporting post 30 covering the plurality of LED light sources 20, a reflective cup 40 located above the supporting post 30, a first lens 50 received in a bottom portion of the reflective cup 40 and a second lens 60 fixed on a top portion of the reflective cup 40. The supporting post 30 is connected to the printed circuit board 10, and the first lens 50 is connected to the supporting post 30. The printed circuit board 10, the reflective cup 40, the first lens 50 and the second lens 60 are combined as a whole by the supporting post 30.

The printed circuit board 10 has a top surface 11.

The plurality of LED light sources 20 are mounted on the top surface 11 of the printed circuit board 10 and are electrically connected to the printed circuit board 10. In this embodiment, the LED light source 20 is an LED package, and the printed circuit board 10 supplies the power to the plurality of LED light sources 20.

The supporting post 30 is located on the top surface 11 of the printed circuit board 10 vertically. The supporting post 30 is a hollow cylinder and accommodates the plurality of LED light sources 20 therein. The supporting post 30 defines a room 33 therein. The supporting post 30 includes an upper annular surface 31 and a lower annular surface 32 opposite to the upper annular surface 31. The lower annular surface 32 contacts to the top surface 11 of the printed circuit board 10.

The reflective cup 40 is funnel-shaped. The top portion of the reflective cup 40 defines a first opening 41, and the bottom portion of the reflective cup 40 defines a second opening 42. An inner diameter of the first opening 41 is greater than that of the second opening 42. An outer diameter of the bottom portion of the reflective cup 40 is equal to an outer diameter of the supporting post 30. The bottom portion of the reflective cup 40 contacts the upper annular surface 31 of the supporting post 30. An inner surface of the reflective cup 40 is a reflective wall 43, and the reflective wall 43 reflects the light which is incident to the reflective wall 43. The reflective wall 43 defines a frustum of cone with diameters thereof gradually decreasing from the top portion of the bottom portion of the reflective cup 40.

The first lens 50 is fixed to the bottom portion of the reflective cup 40 and fitly engaged in the second opening 42 of the reflective cup 40. The first lens 50 contacts the upper annular surface 31 of the supporting post 30. In this embodiment, the first lens 50 is a concentric Fresnel lens with periodic arrangement. The first lens 50 has a top surface 51 and a bottom surface 52 opposite to the top surface 51. The top surface 51 defines a plurality of concentric annular protrusions, and the bottom surface 52 is a flat surface. The bottom surface 52 faces the plurality of LED light sources 20. Light emitted from the LED light sources 20 travels to and is refracted by the first lens 50 and further is transmitted to the reflective cup 40 and the second lens 60. The first lens 50 can make the light emitting from the LED light sources 20 more uniform.

The second lens 60 is fixed to the top portion of the reflective cup 40 and fitly engaged in the first opening 41 of the reflective cup 40. The second lens 60 has an upper surface 61 facing the first lens 50 and a lower surface 62 opposite to the upper surface 61. A middle of the upper surface 61 of the second lens 60 is concaved downwardly to defines a first groove 63, the upper surface 61 is concaved downwardly to define a plurality of second grooves 64 surrounding the first groove 63. In this embodiment, the plurality of second grooves 64 is symmetrical relative to the first groove 63, and is arranged uniformly. A size of the first groove 63 is larger than that of the second groove 64. A cross-section of the first and second groove 63, 64 is semicircular, and an inner diameter of the first groove 63 is greater than that of the second groove 64. When light travels to the second lens 60, for the first groove 63 and the second groove 64 being defined in the upper surface 61 of the second lens 60, and the inner diameter of the first groove 63 being greater than that of the second groove 64, the light output of the second lens 60 is more uniform, the light intensity decreases at the forward direction and increases at the lateral direction.

During operation of the LED light source 20, the light emitted from the LED light source 20 travels toward the first lens 50 through the room 33 of the supporting post 30. For the first lens 50 being a Fresnel lens, the light emitting from the LED light sources 20 has a uniform distribution of light output when it travels through the first lens 50, and further travels toward the second lens 60. A part of the light is refracted to the interior of the second lens 60, and the other part of the light is reflected to the reflective wall 43 of the reflective cup 40 by the second lens 60, by repeating reflection of the reflective wall 43, more and more light is output from the second lens 60. For the first groove 63 and the plurality of second grooves 64 being defined in the second lens 60, and the inner diameter of the first groove 63 being greater than that of the second groove 64, the light output of the second lens 60 is more uniform, thereby decreasing the light intensity at the forward direction and increasing at the lateral direction.

A particular embodiment is shown and described by way of illustration only. The principles and the features of the present disclosure may be employed in various and numerous embodiments thereof without departing from the scope of the disclosure as claimed. The above-described embodiment illustrates the scope of the disclosure but does not restrict the scope of the disclosure.

What is claimed is:

1. An illumination device, comprising:

a printed circuit board;

a plurality of LED light sources mounted on the printed circuit board, and the plurality of LED light sources being electrically connected to the printed circuit board;

a hollow supporting post covering the plurality of LED light sources, and the supporting post being connected to the printed circuit board;

a reflective cup located above the supporting post, the reflective cup comprising a bottom portion adjacent to the LED light sources and a top portion remote from the LED light sources;

a first lens received in the bottom portion of the reflective cup, and the first lens facing the plurality of LED light sources; and a second lens located at the top portion of the reflective cup opposite to the first lens;

wherein light emitted from the plurality of LED light sources pass through and are dispersed by the first lens, and then the light transmitted from the first lens pass through and are dispersed by the second lens.

2. The illumination device of claim 1, wherein the reflective cup is funnel-shaped, the top portion of the reflective cup defines a first opening, the bottom portion of the reflective cup defines a second opening, an inner diameter of the first opening is greater than that of the second opening, the first lens is located at the second opening of the reflective cup, and the second lens is located at the first opening of the reflective cup.

3. The illumination device of claim 2, wherein the first lens is a Fresnel lens.

4. The illumination device of claim 3, wherein the first lens has a top surface and a bottom surface opposite to the top surface, the top surface defines a plurality of concentric annular protrusions, the bottom surface is a flat surface, and the bottom surface faces the plurality of LED light sources.

5. The illumination device of claim 2, wherein a middle of the second lens is concaved downwardly to define a first groove, and a periphery of the second lens is concaved downwardly to define a plurality of second grooves surrounding the first groove.

6. The illumination device of claim 5, wherein the second lens comprises an upper surface facing the first lens and a lower surface opposite to the upper surface, the first groove and the plurality of second grooves are defined on the upper surface of the second lens.

7. The illumination device of claim 6, wherein a cross-section of each of the first and second groove is semicircular, and an inner diameter of the first groove is greater than that of the second groove.

8. The illumination device of claim 7, wherein the plurality of second grooves are symmetrical relative to the first groove.

9. The illumination device of claim 1, wherein the supporting post is a hollow cylinder and defines a room therein, the supporting post comprises an upper annular surface and a lower annular surface opposite to the upper annular surface, the lower annular surface contacts the printed circuit board, the first lens and the bottom portion of the reflective cup contact the upper annular surface.

10. The illumination device of claim 1, wherein an inner surface of the reflective cup is a reflective wall, the reflective wall reflecting the light which is incident to the reflective wall.

11. An illumination device, comprising:

a printed circuit board;

a plurality of LED light sources mounted on the printed circuit board, and the plurality of LED light sources being electrically connected to the printed circuit board;

a hollow supporting post covering the plurality of LED light sources, and the supporting post being connected to the printed circuit board;

a funnel-shaped reflective cup located above the supporting post;

a first lens received in a bottom portion of the reflective cup, and the first lens being connected to a top portion of the supporting post; and a second lens located at a top portion of the reflective cup opposite to the first lens;

wherein the first lens is a Fresnel lens, the second lens comprises an upper surface facing to the first lens and a lower surface opposite to the upper surface, a middle of the upper surface of the second lens is concaved downwardly to define a first groove, and a periphery of the upper surface of the second lens is concaved downwardly to define a plurality of second grooves surrounding the first groove.

12. The illumination device of claim 11, wherein the top portion of the reflective cup defines a first opening, the bottom portion of the reflective cup defines a second opening, an inner diameter of the first opening is greater than that of the second opening, the first lens is located at the second opening of the reflective cup, and the second lens is located at the first opening of the reflective cup.

13. The illumination device of claim 11, wherein the first lens comprises a top surface and a bottom surface opposite to the top surface, the top surface defines a plurality of concentric annular protrusions, the bottom surface is a flat surface, and the bottom surface faces to the plurality of LED light sources.

14. The illumination device of claim 11, wherein a cross-section of each of the first and second groove is semicircular, and an inner diameter of the first groove is greater than that of the second groove.

15. The illumination device of claim 14, wherein the plurality of second grooves are symmetrical relative to the first groove.

16. The illumination device of claim 11, wherein the supporting post is a hollow cylinder and defines a room therein, the supporting post comprises an upper annular surface and a lower annular surface opposite to the upper annular surface, the lower annular surface contacts the printed circuit board, the first lens and the bottom portion of the reflective cup contact the upper annular surface.

17. The illumination device of claim 11, wherein an inner surface of the reflective cup is a reflective wall, and the reflective wall reflects the light which is incident to the reflective wall.

* * * * *